US005608186A

United States Patent [19]

Collins, Jr. et al.

[11] Patent Number: 5,608,186

[45] Date of Patent: Mar. 4, 1997

[54] GROUND ROD

[75] Inventors: Albert L. Collins, Jr., Germantown, Tenn.; Rick A. Boyd, Olive Branch, Miss.; Herbert L. Bradshaw, II, Germantown, Tenn.; Alvin J. Huber, Tulsa, Okla.; Charles T. Wessner, Freehold, N.J.; Dennis B. Ruch, Memphis, Tenn.

[73] Assignee: Thomas & Betts Corporation, Memphis, Tenn.

[21] Appl. No.: 236,647

[22] Filed: May 2, 1994

Related U.S. Application Data

[63] Continuation of Ser. No. 825,971, Jan. 27, 1992, abandoned.

[51] Int. Cl.[6] ..... H01R 4/66

[52] U.S. Cl. ..... 174/7

[58] Field of Search ..... 174/7, 6, 1, 2, 174/3; 135/118; D30/154

[56] References Cited

U.S. PATENT DOCUMENTS

| | | | |
|---|---|---|---|
| 1,891,943 | 12/1932 | Nimick | 174/7 |
| 3,012,089 | 12/1961 | Ridgers | 174/7 |
| 4,156,793 | 5/1979 | Carlson | 174/7 |
| 4,577,053 | 3/1986 | Kies | 174/7 |

FOREIGN PATENT DOCUMENTS

| | | | |
|---|---|---|---|
| 7630621 | 10/1976 | France | 174/7 |

*Primary Examiner*—Kristine L. Kincaid
*Assistant Examiner*—Paramita Ghosh
*Attorney, Agent, or Firm*—H. Duane Switzer; Michael L. Hoelter

[57] ABSTRACT

The entire outer surface of a ground rod, including its pointed end portion, has a continuous and uniform electroplated coating. The rod has a blunt end portion shaped to minimize mushrooming when it is hammered for driving the rod into the ground. Jets of plating solution directed against the rod produce swirling motion of plating solution around the rod while it moves longitudinally through a plating bath. Uniformity of the plated coating may be enhanced by rotating the rod during longitudinal movement through the plating bath.

15 Claims, 14 Drawing Sheets

GROUND ROD

This is a continuation, of application Ser. No. 07/825,971, filed Jan. 27, 1992, now abandoned.

BACKGROUND OF THE INVENTION

This application relates to the art of electrical ground rods, and to an apparatus and method for electroplating same. Although the invention will be described with specific reference to electrical ground rods, it will be appreciated that the apparatus and method can be used for electroplating other workpieces.

Conventional procedures for manufacturing and electroplating electrical ground rods often produce rods that are not plated with a continuous uniform coating over substantially their entire outer surface. In rack plating, the areas of the rods supported on the racks may remain unplated, or have a plating that is not of the same thickness as the remainder of the rod. The rods are also located different distances from the anodes, and the ends of the rods may receive heavier coatings so the rods take on a dog bone effect. The ends of the rods must then be cut off and one end of the rod shaped to a point. The cut and pointed ends then remain unplated.

Electrical ground rods are also manufactured by electroplating a continuous length of wire which is then cut to desired lengths, and the individual lengths are shaped to a point at one end. Again, the severed and pointed end portions remain unplated.

When a rod is plated by moving same longitudinally between sacrificial anodes, the areas of the rod facing directly toward the anodes receive a thicker plating than the rod areas facing away from the anodes. This wastes plating metal by requiring overplating of the rod areas facing the anodes in order to obtain adequate plating thickness on the rod areas facing away from the anodes.

During plating, ions are rapidly depleted from the plating solution adjacent the rod. Air bubble agitation of the plating solution has been used to alleviate this problem but cannot replace such ions adjacent the rod as fast as they are depleted.

It would be desirable to have an electrical ground rod that is provided with a substantially continuous and uniform plating over substantially its entire outer surface, including its pointed end portion. It would also be desirable to have a ground rod with a blunt end portion arranged to minimize mushrooming when hammered for driving the rod into the ground.

SUMMARY OF THE INVENTION

An electrical ground rod has a substantially continuous and uniform electroplated coating over substantially its entire outer surface, including its pointed and blunt end portions.

The blunt end portion of the ground rod has a central dimple and an external chamfer for minimizing mushrooming of the blunt end when it is hammered for driving the rod into the ground.

In accordance with the present application, electrical ground rods are cut to desired length and shaped to a point at one end before electroplating. A plurality of the rods are positioned in end-to-end relationship with pointed and blunt ends of adjacent rods engaging one another to form a rod string. The initial rod in the rod string is longitudinally driven and the longitudinal pushing force is transmitted through all of the rods in the rod string. Thus, the only areas of the rod that are not provided with the substantially continuous and uniform electroplated coating are very small areas at the tip of the pointed end and at the blunt end where adjacent rods in the rod string engage one another.

In a preferred arrangement, jets of plating solution are directed toward the rods during electroplating to cause a swirling motion of electroplating solution around the rods as they move longitudinally through the plating bath. This rapidly replaces the solution surrounding the outer surface of the rod and thereby provides adequate ions for efficient electroplating.

In another arrangement, the rods may be rotated simultaneously with longitudinal movement thereof through the plating bath. This provides uniform exposure of all circumferential surfaces of a rod to the anodes during movement of the rod through the plating bath.

Rotation of the rods is preferably accomplished by partly converting longitudinal movement of the rods into rotational movement thereof. In a preferred arrangement, this is done by longitudinally moving the rods through a plurality of skewed rollers. The periphery of the skewed rollers moves both longitudinally and circumferentially relative to the rod and thereby imparts rotational movement thereto.

It is a principal object of the present invention to provide an improved electrical ground rod having a substantially continuous and uniform electroplated coating on substantially its entire outer surface.

It is another object of the invention to provide a ground rod with an improved blunt end portion that is shaped for minimizing mushrooming when hammered for driving the rod into the ground.

It is an additional object of the invention to provide an improved apparatus and method for electroplating ground rods.

It is a further object of the invention to provide an improved arrangement for longitudinally moving a plurality of individual electrical ground rods through a plating bath.

It is also an object of the invention to provide an improved arrangement for swirling electroplating solution around a rod for rapidly replacing ions in the solution adjacent the outer surface of the rod.

It is an additional object of the invention to provide an improved arrangement for rotating rods during longitudinal movement thereof through a plating bath.

DESCRIPTION OF PREFERRED EMBODIMENTS

Figure 1:
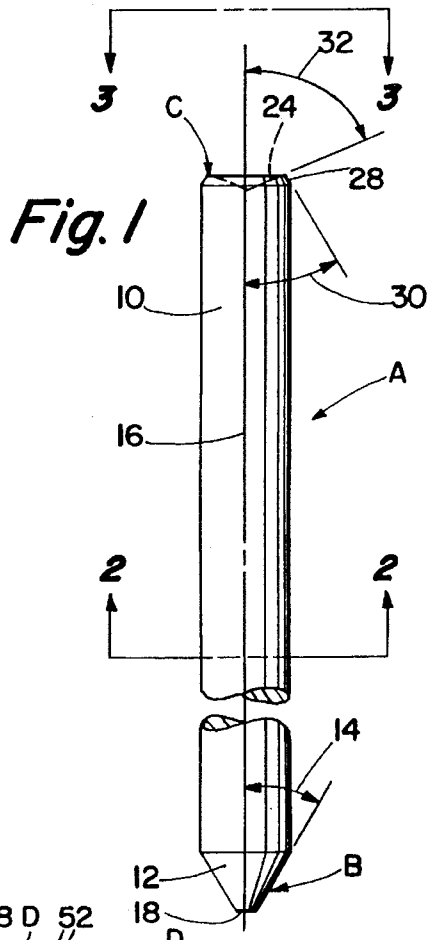
FIG. 1 is plan view of an electrical ground rod constructed in accordance with the present application.

Referring now to the drawing, wherein the showings are for purposes of illustrating certain preferred embodiments of the invention only and not for purposes of limiting same, FIG. 1 shows an elongated electrical ground rod A having a pointed end portion B and a blunt end portion C. Rod A has a cylindrical outer peripheral surface 10 along its entire length between pointed and blunt end portions B, C.

Pointed end portion B has a tapered outer surface 12 that lies on the surface of a cone, and extends at an angle 14 with rod longitudinal axis 16 of between 20°–40°, more preferably about 25°–35°, and most preferably within a few degrees of 30°. Pointed end portion B terminates in a blunt or flat tip 18 that is coincidental with rod longitudinal axis 16 and has an area not greater than about 25% of the cross-sectional area of the rod. Preferably, blunt tip 18 has an area that is substantially less than 25% of the cross-sectional area of the rod. Obviously, the pointed end portion can have other shapes, such as pyramidal or wedge-like, and the tip does not have to be circular or coincidental with the rod longitudinal axis as it is in the most preferred embodiment.

Figure 2:
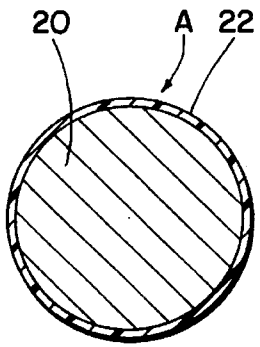
FIG. 2 is a cross-sectional elevational view taken generally on line 2—2 of FIG. 1.

FIG. 2 shows rod A as comprising a solid base metal rod 20 having its outer surface provided with an electroplated coating 22. While base metal rod 20 is usually of steel, and coating 22 is of copper, it will be recognized that different metals may be used for both the base metal rod and the plated coating thereon. For example, the plated coating may be zinc.

Figure 3:
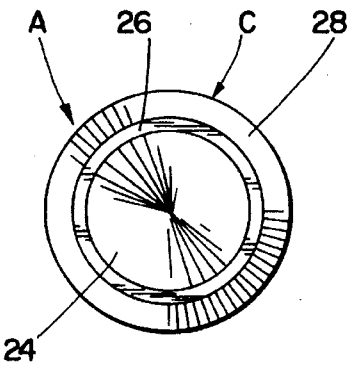
FIG. 3 is an end elevational view taken generally on line 3—3 of FIG. 1.

FIG. 3 shows rod blunt end portion C as having a centrally located dimple 24 therein of generally conical configuration. However, it will be recognized that rounded configurations could also be provided. A small circular flat area 26 surrounds dimple 24 and intersects a circumferential chamfer 28 that is inclined at an angle 30 relative to rod longitudinal axis 16 of between 20°–40°, more preferably about 25°–35°, and most preferably within a few degrees of 30°. As shown in FIG. 1, dimple 24 slopes inwardly at an angle to rod longitudinal axis 16 between about 60°–80°, and most preferably about 65°–75°. The area of the end surface of the rod that is occupied by dimple 24 comprises about 60–80% of the cross-sectional area of the rod. Chamfer 28 is arranged such that its intersection with rod outer peripheral surface 10 is about the same distance from circular flat portion 26 as the bottom of dimple 24. The depth of the dimple may vary depending on the diameter of the rod.

Figure 4:
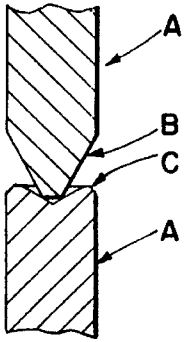
FIG. 4 is a partial cross-sectional plan view showing blunt and pointed end portions of two adjacent rods in engagement with one another.

As shown in FIGS. 1 and 4, the depth of dimple 24 along rod longitudinal axis 16 is substantially less than the length of tapered outer surface 12 on pointed end portion B along rod longitudinal axis 16. This relationship and the fact that dimple 24 is very shallow are also apparent from the very steep slope of tapered outer surface 12 with angle 14 being only about 20°–40°compared to the very gradual slope of the surface of dimple 24 with angle 32 being about 60°–80 °.

The described shape for blunt end portion C causes the metal to flow inwardly rather than outwardly when the blunt end is hammered for driving the rod into the ground. This minimizes outward mushrooming of the blunt end portion and facilitates installation of a ground wire clamp over the blunt end portion of the rod.

In manufacturing electrical ground rods in accordance with the present application, all of the rods are cut to length, and provided with pointed and blunt end portions shaped as described with respect to FIGS. 1 and 3 prior to being electroplated.

FIG. 4 shows a pair of ground rods A positioned in end-to-end longitudinally aligned relationship with the blunt and pointed end portions of adjacent rods engaging one another. As shown in FIG. 4, the tip of the pointed end portion is received in the dimple on an adjacent rod, and this assists in maintaining longitudinal alignment of all the rods in a rod string. That is, there is a slight lateral interlock to inhibit lateral relative displacement of blunt and pointed end portions on adjacent rods in a rod string. However, the rods are unconnected and are completely free to rotate relative to one another. Relative lateral movement between adjacent rods is also limited by virtue of the guide bushings through which the rods move with a loose guiding fit.

Figure 5:
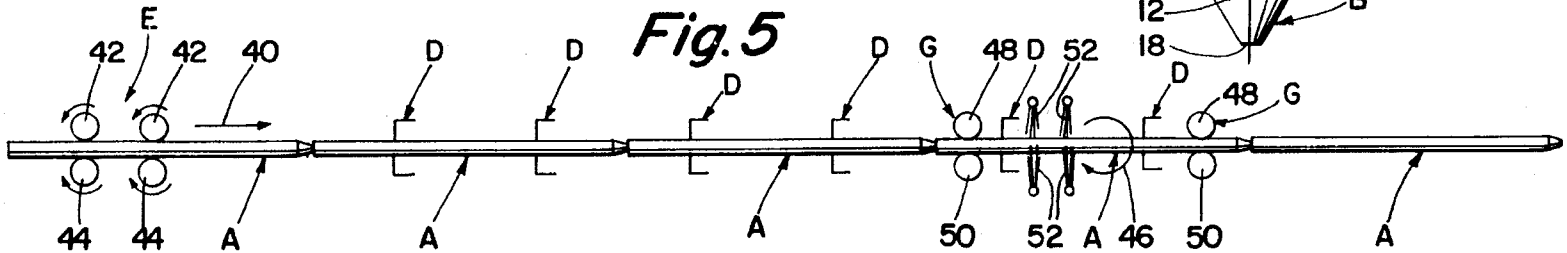
FIG. 5 is a schematic view showing a plurality of rods in a rod string being driven through an electroplating operation.

FIG. 5 shows a plurality of rods A positioned in end-to-end longitudinal alignment with the pointed and blunt end portions of adjacent rods engaging one another to form a rod string. The rod string can have many different lengths, and is usually over 100 feet long. The number of rods in the string will depend upon the length of each rod. Ordinarily, there are many rods in a rod string. However, it will be recognized that even a single rod can be processed in accordance with certain of the procedures of the present application.

As shown in FIG. 5, a plurality of longitudinally spaced-apart guide means in the form of guide channels D are provided for longitudinally guiding the rods in the rod string during longitudinal movement thereof through an electroplating system. The guide channels are spaced-apart about twelve inches. The guide channels and openings in the tank walls guide the rods through the entire plating system.

Longitudinal drive means E is provided for imparting longitudinal movement to an initial rod in the rod string as indicated by arrow 40. The drive means may comprise opposed pairs of rollers 42, 44, with at least one roller 42 in each pair being rotatably driven. One roller in each pair rotates clockwise, while the other rotates counter-clockwise. The longitudinal driving force imparted to the initial rod is transferred from rod-to-rod through all of the rods in the rod string.

At a location remote from longitudinal drive means E, and spaced therefrom by a plurality of intermediate rods A, rotary drive means G is provided for imparting rotation to a rod as indicated by arrow 46. Each rotary drive means G may comprise a plurality of skewed rollers 48, 50 that are rotated by longitudinal movement of a rod A therepast. When the skewed rollers are rotated, part of the longitudinal movement of the rod is converted into rotary motion because the skewed rollers rotate with a component of force acting circumferentially on the rod. Thus, the rod simultaneously moves longitudinally and rotatably through an electroplating bath.

FIG. 5 also shows jets 52 of plating solution being directed against the outer surface of a rod A. Jets 52 act generally circumferentially of the rod for imparting high velocity swirling motion to the plating solution for rapidly replacing the solution adjacent the rod surface, and thereby providing new ions to replace those depleted from the solution adjacent the rod.

The electroplated rods have a substantially continuous and uniform electroplated coating thereon over their entire surface, including both the pointed and blunt end portions thereof. The only areas of the rod not provided with the substantially uniform and continuous electroplated coating are the pointed end tip 18 and an area within blunt end depression 24 that is about the same size as blunt tip 18. This is because those areas of adjacent rods engage one another and inhibit plating action.

The rods are connected to a source of electric potential, and engagement between adjacent rods also creates a slight burn area on tip 18 and a corresponding area within depression 24. It will be recognized that it may be possible to pull the last rod in the rod string away from the next-to-last rod in the last plating tank. This will provide an electroplated coating on the entire blunt end portion of the last rod and the pointed end tip on the next to last rod. This can be done with all of the rods so that even the pointed end tip and a corresponding area within the blunt end dimple would also be provided with an electroplated coating. However, the coating in those two areas would not have the same continuity and uniformity as the electroplated coating on the remaining outer surface area of the rod.

Figure 6:
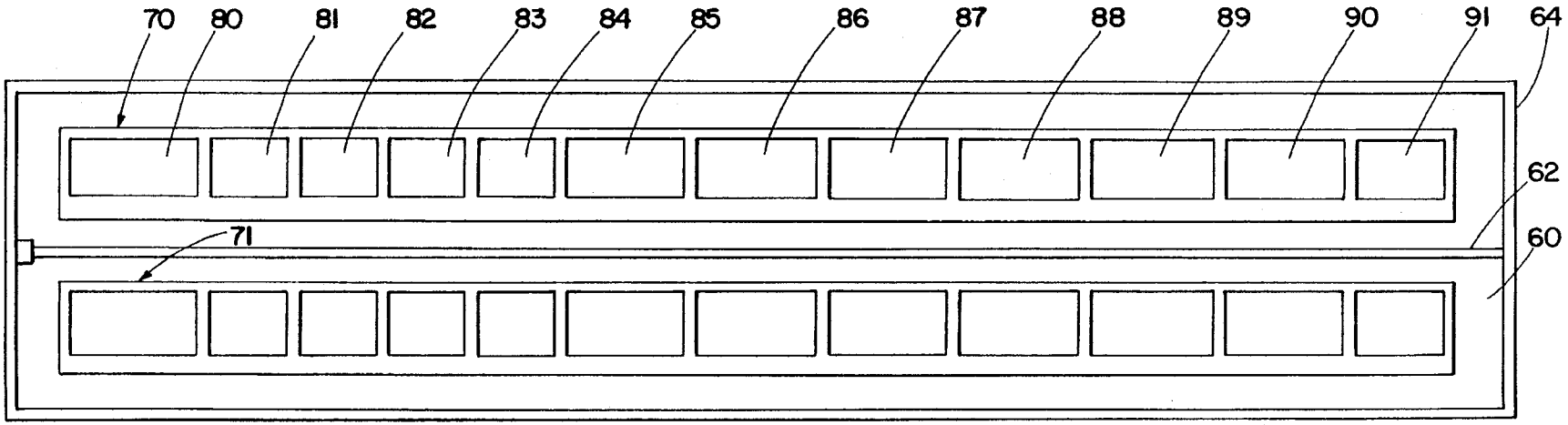
FIG. 6 is plan view of a typical plating installation.

FIG. 6 shows a typical electroplating layout wherein a concrete base 60 has a drain trough 62, and is surrounded by peripheral curb 64. Two separate plating lines 70 and 71 are shown, although it will be appreciated that any desired number of plating lines can be used. Line 70 is shown as including individual tanks 80–91. The arrangement of the tanks and their function will vary depending upon the type of metal being plated. In a typical arrangement for plating copper, tanks 80 and 82 are electrocleaning tanks in which the rods are connected as anodes for removing ions from the outer surface thereof to clean same. Tanks 81 and 83 are pickle tanks for preparing and cleaning the outer surfaces of the rods. Tank 84 is a nickel flash tank when copper is being plated. Tanks 85–90 are electroplating tanks wherein the electroplated coating is applied to the rods. Each of the electroplating tanks 85–90 may have the same or somewhat different chemistry in the plating solution. Tank 91 is known as an inhibitor tank. This is a typical arrangement for any electroplating operation, and the chemicals used for typical electroplating form no part of the present invention. Each line 70, 71 may be designed to handle a plurality of individual rod strings. By way of example only and not by way of limitation, each line could handle ten individual rod strings so that the arrangement shown in FIG. 6 would be capable of processing 20 individual rod strings simultaneously.

Figure 7:
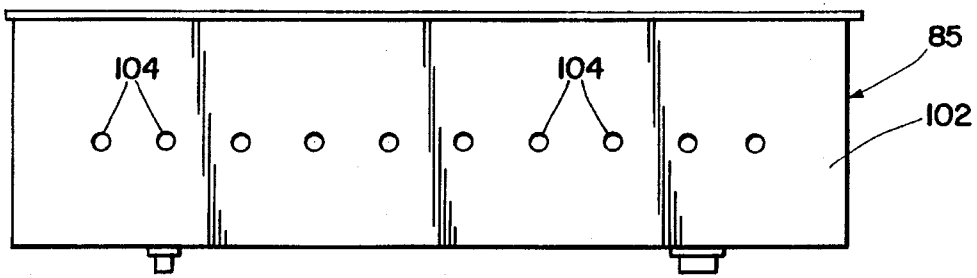
FIG. 7 is an end elevational view of a tank used in the apparatus and method of the present application.
Figure 8:
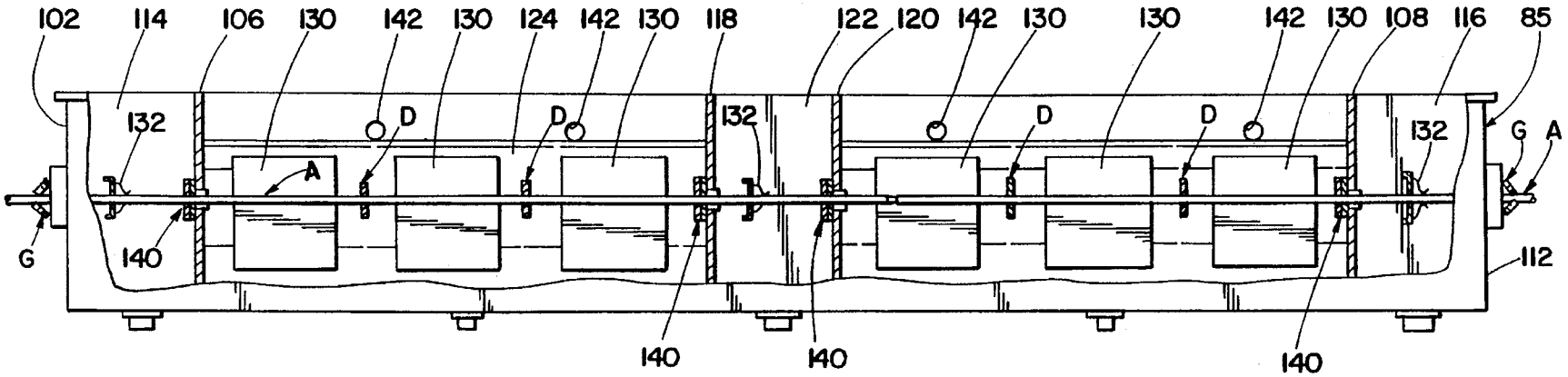
FIG. 8 is a side elevational view of the tank of FIG. 7, and with the side wall cut-away for clarity of illustration.
Figure 9:
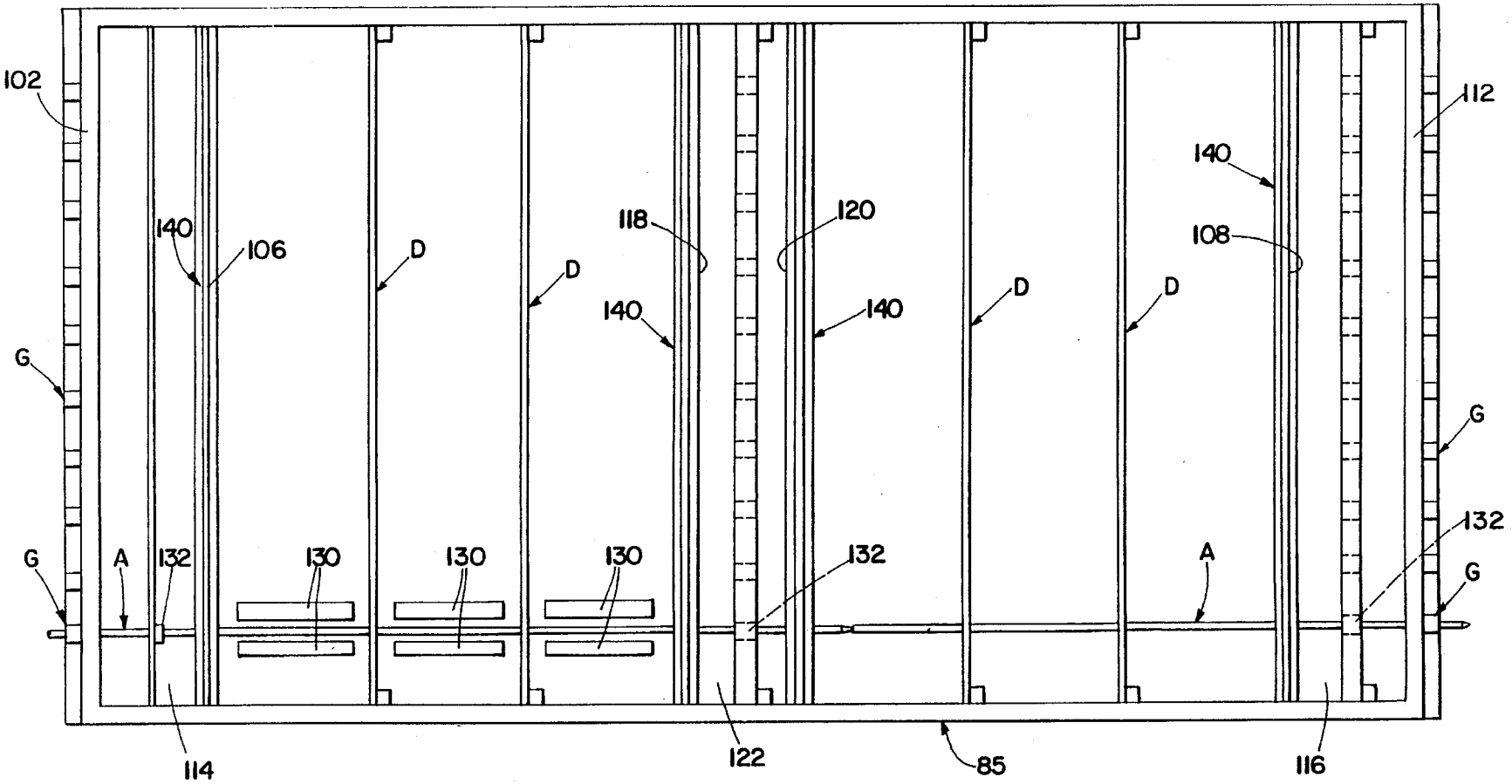
FIG. 9 is a top plan view of a tank used in the plating apparatus and method of the present application.

FIGS. 7–9 show a typical plating tank 85 having a continuous peripheral wall, a bottom and an open top. As shown in FIG. 7, end wall 102 has ten spaced-apart holes 104 therethrough. The holes are located intermediate the top and the bottom of the tank and are below the level of the plating solution within the tank. The opposite end wall has corresponding holes in alignment with the holes 104.

FIG. 8 shows end baffles 106, 108 extending completely across the side walls of tank 85 in inwardly-spaced relationship to end walls 102, 112 to define end chambers 114, 116. A pair of spaced-apart central baffles 118, 120 extend completely across the side walls of tank 85 to define a central chamber 122. A pair of plating chambers are defined between baffles 106, 118 and 108, 120.

As shown in FIG. 8, a rotary drive means G is mounted adjacent at least the tank input end wall 102 for rotating rods A in each rod string as they pass through plating solution 124 within tank 85. Obviously, the rotary drive means can be mounted in any dry area. The solution will contain copper sulfate and sulfuric acid when copper is being plated.

Titanium baskets 130 containing scrap copper, phosphorized copper or other metal to be plated on the rods are suspended within tank 85 on opposite sides of each rod string. The closer the titanium baskets are to the rods, the less voltage required and the more efficient the plating operation. With the arrangement of the present application, the space between rods and anode baskets can be less than around one inch. A much smaller rectifier can then be used to obtain a high amperage of up to 2,800 amps per square foot of rod for efficient plating.

Electrical brush assemblies 132 are mounted within each chamber 114, 116, 120 for connection to a source of electrical potential making the rods cathodes while the baskets 130 are connected as anodes. Seal assemblies 140 are mounted on each baffle 106, 108, 118 and 120 for inhibiting flow of plating solution into chambers 114, 116 and 122. Guides D are provided within tank 85 for guiding the rods as they move longitudinally through the tank.

It will be recognized that the tank 85 is connected with a reservoir or mother tank of plating solution, and that pumps and drains are provided for continuously circulating and replenishing the plating solution. Overflow openings 142 in the tank side wall also communicate with the mother tank, and serve to maintain a desired plating solution level within the tank.

Although the tank shown in FIGS. 7–9 has a pair of liquid-containing or plating chambers and three essentially dry chambers, it will be recognized that many of the other tanks can have different arrangements. For example, at least one electroclean tank can be similar to the tank shown in FIGS. 6–9 but have two essentially dry chambers adjacent to one end. The extra chamber at the discharge end of such tank would have spray nozzles for spraying the rods to remove the electrocleaning solution therefrom. Other tanks may have the essentially dry chambers at only the opposite ends of the tank and none in the middle. Various water sprays and air sprays may be located in the dry chambers for removing solution from a rod before the rod moves into the next tank.

Figure 10:
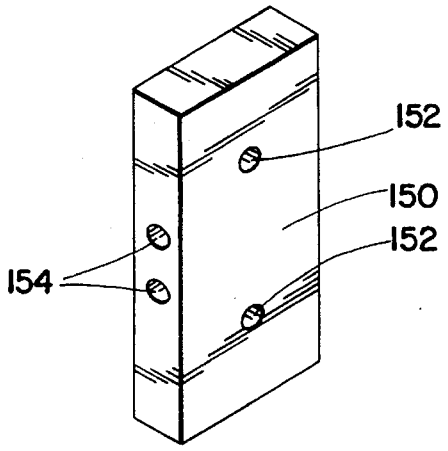
FIG. 10 is a perspective illustration of a mounting block used for mounting guide channels to a tank.

FIG. 10 shows a generally rectangular mounting block having holes 152 therethrough alignable with suitable holes in a tank side wall for receiving fastener assemblies to attach the mounting block 150 to the interior of the tank side wall. Additional holes or threaded bores 154 in mounting block 150 receive additional fastener assemblies for suspending guide channels and electric brush assembly channels between opposite tank side walls.

Figure 11:
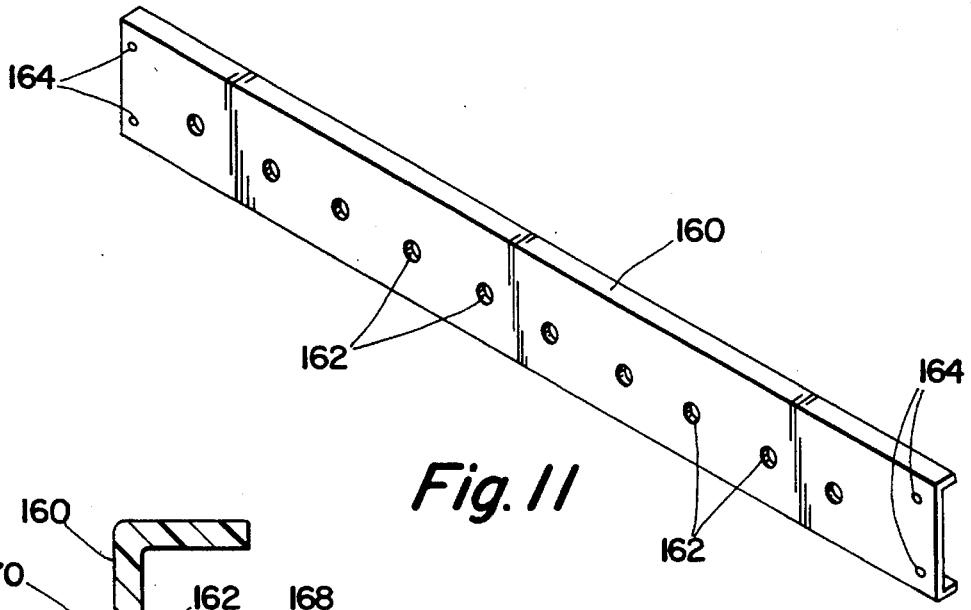
FIG. 11 is a perspective illustration of a guide channel.

FIG. 11 shows a guide channel 160 having ten spaced-apart holes 162 therethrough for passage of electrical ground rods therethrough. Channel 160 has suitable holes 164 in its web adjacent its opposite end portions alignable with holes 154 in mounting block 150 of FIG. 10. Fastener assemblies passing through the holes 154, 164 are used to suspend a guide channel 160 across opposed tank side walls.

Figure 12:
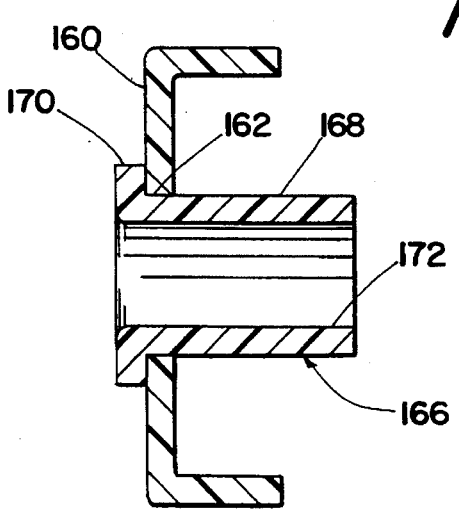
FIG. 12 is a cross-sectional elevational view showing a guide bushing received through a hole in a guide channel.

FIG. 12 shows a plastic bushing 166 having a cylindrical sleeve portion 168 closely received through a hole 162 in guide channel 160. A circumferential flange 170 at one end of guide bushing 166 engages the outer surface of the channel web. Epoxy or other adhesive may be used for securing bushing 166 to channel 160. However, it will be recognized that snap-fitting bushings may also be used. The cylindrical hole 172 through bushing 166 provides a loose sliding fit of an electrical ground rod therethrough. A bushing 166 is provided in each hole in each guide channel. Use of bushings is optional for the holes in the tank walls and baffles, and in the channels for the electric brushes and rotary drive means.

Figure 13:
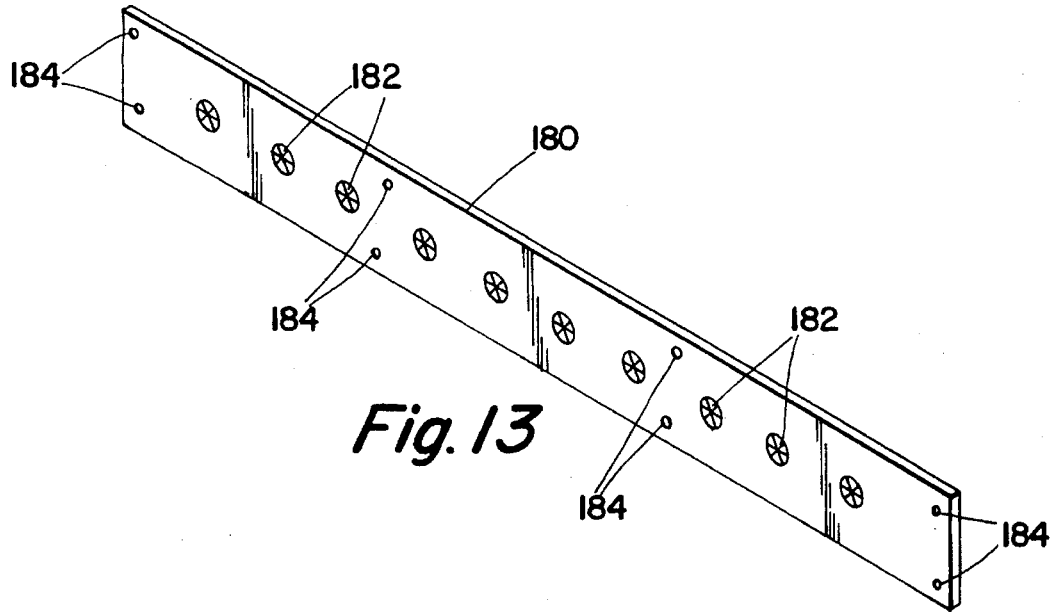
FIG. 13 is a perspective illustration of a sealing gasket.

FIG. 13 shows an elastomeric sealing strip 180 of suitable flexible sealing material, such as open cell foam, having a plurality of spaced-apart openings 182 therethrough formed by slits through the foam material. The openings defined by the slits have the same spacing as the spacing of the holes in the guide channels, tank end walls and electric brush support channels. A plurality of holes 184 through strip 180 are adapted to receive fastener assemblies. Obviously, there could be an individual gasket for each hole instead of an elongated strip gasket. Also, the openings in the gasket could be circular holes instead of slits.

Figure 16:
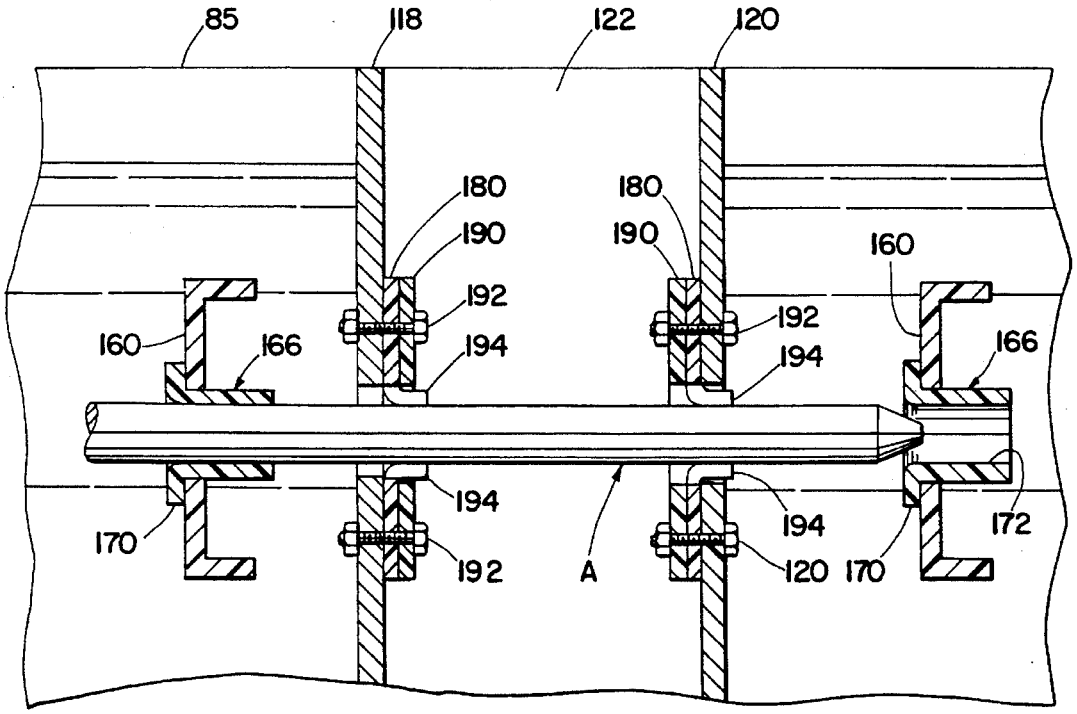
FIG. 16 is a partial cross-sectional elevational view showing a rod moving through guide channels and seals in a tank.

A gasket or seal securing plate has a shape similar to that shown in FIG. 13, but is made of a material that is resistant to chemical attack and has holes instead of slits therethrough. This is shown in FIG. 16 wherein the gaskets or seals are secured against surfaces of baffles 118, 120 by positioning gasket securing plates 190 thereagainst, and securing the assembly to its baffle wall by fastener assemblies 192. The gasket material in the areas of the openings defined by the slits flexes as generally indicated at 194 in FIG. 16 to wipe solution from a rod, and to maintain a good seal between a relatively dry chamber and a liquid plating chamber.

Figure 15:
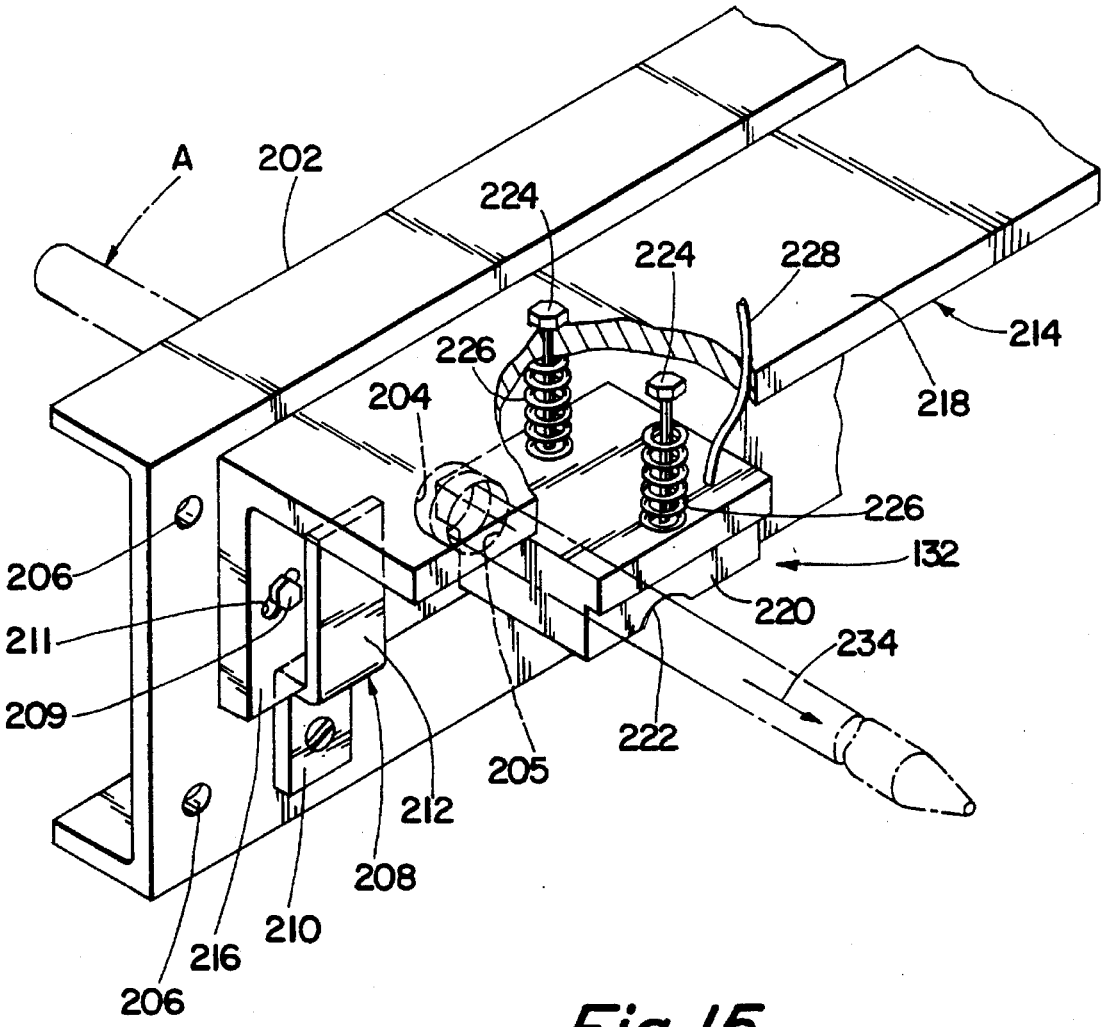
FIG. 15 is a perspective illustration of an electrical brush arrangement.

FIG. 15 shows an electrical brush mounting channel 202 having a plurality of spaced-apart holes 204 therethrough for passage of rods therethrough. Fastener receiving holes 206 in the web of channel 202 adjacent its opposite ends are adapted to be aligned with suitable holes in a mounting block as described with reference to FIG. 10 for suspending a brush mounting channel between opposite tank side walls.

Brackets 208 have attachment legs 210 secured by suitable fastener assemblies to the web of channel 202, and retainer legs 212 spaced outwardly from the channel web to define a pocket. A plurality of the brackets 208 may be spaced along the length of channel 202.

An angle member 214 has a vertical leg 216 received behind retainer legs 212 on brackets 208, and a horizontal leg 218 on which electrical brush assemblies 132 are mounted. Vertical leg 216 has holes 205 aligned with holes 204 in channel 202. A conductive block or electrical brush 220 has an arcuate groove 222 therein engaging the upper portion of a rod A. Bolts 224 extend through suitable holes in angle member leg 218 and through suitable holes in conductive block 220. Suitable nuts are placed on the ends of the bolts on the opposite side of the conductive block 220. The block can move up and down on the bolts 224. Coil springs 226 around the bolts bear against the underside of angle member leg 218 and the top surface of conductive block 220 for biasing the surface of block groove 222 into engagement with rod A. The rod bottoms out on the guide bushings or the holes through which it moves. A brush assembly 132 is mounted adjacent each rod hole 204 in channel 202. A conductor 228 is attached to conductive block 220 and to a voltage source. Vertical leg 216 of angle member 214 has inclined slots 211 for receiving fastener assemblies 209 that extend through suitable holes in channel 202. This allows securement of angle member 214 to channel 202 with holes 204, 205 in alignment.

Rods A are preferably moved past a brush assembly in the direction indicated by arrow 234 in FIG. 15. Thus, a rod A moving through a channel hole 204 and an angle member hole 205 engages the arcuate surface of brush groove 222 and slides therepast. Brush 220 is connected to a source of electrical potential that makes the rods cathodes in the plating tanks. In the electroclean tanks, the brushes are connected to make the rods anodes.

Figure 14:
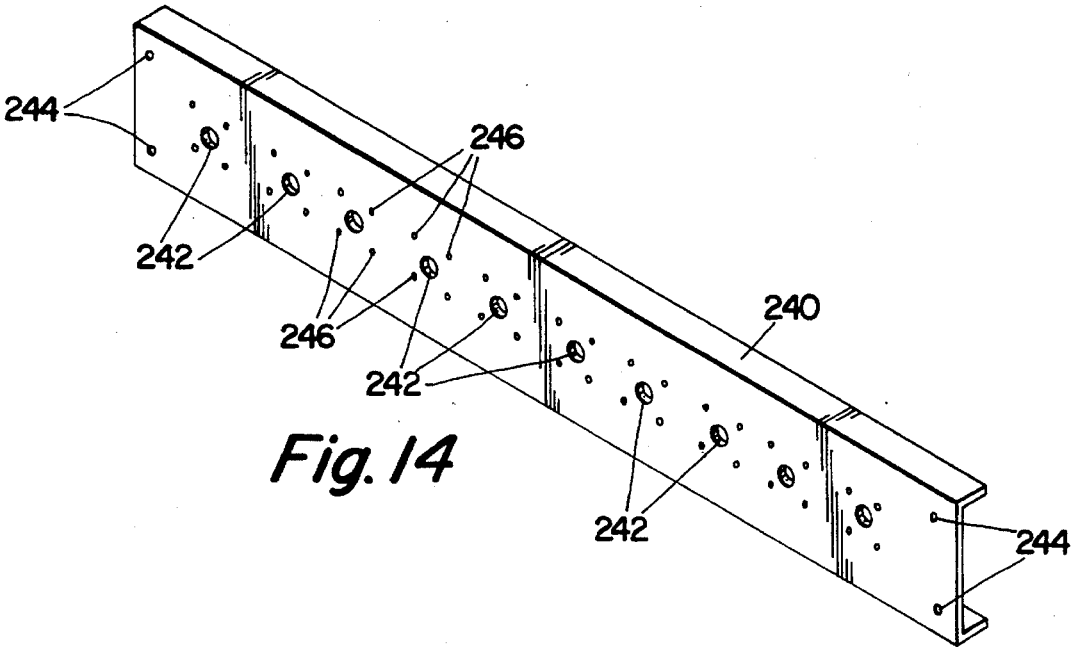
FIG. 14 is a perspective illustration of a mounting channel for rod rotating drive means.

With reference to FIG. 14, a rotary drive mounting channel 240 has ten spaced-apart holes 242 therethrough for passage of rods therethrough. Fastener receiving holes 244 in the web of channel 240 adjacent its opposite ends are adapted to receive fastener assemblies for attaching same to the end wall of a tank. A plurality of fastener receiving openings 246 are spaced-apart around each hole 242 for mounting a rotary drive means to the channel in alignment with each hole 242 therein.

Figure 17:
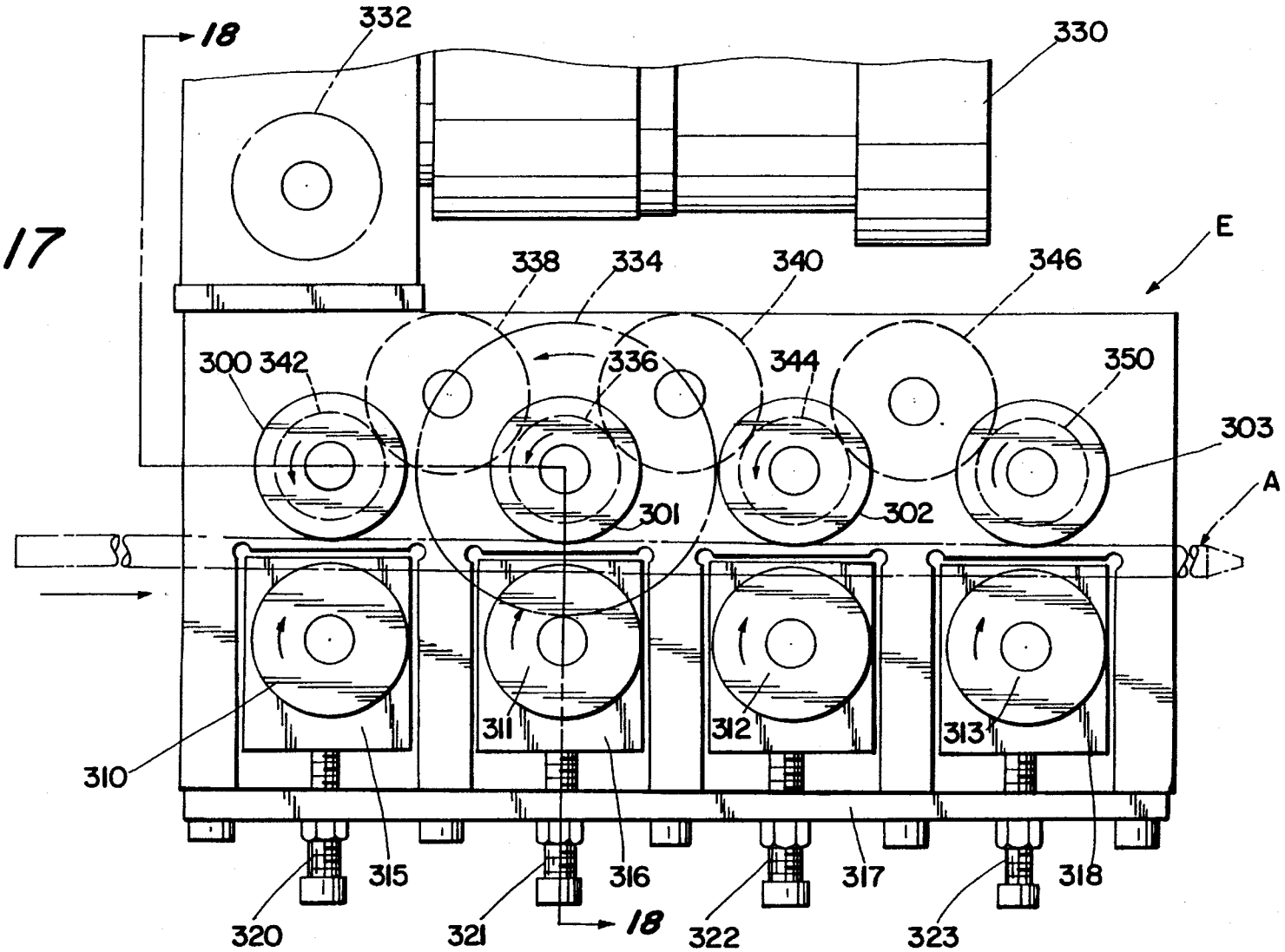
FIG. 17 is a side elevational view of a longitudinal drive means used for longitudinally driving ground rods through a plating operation.
Figure 18:
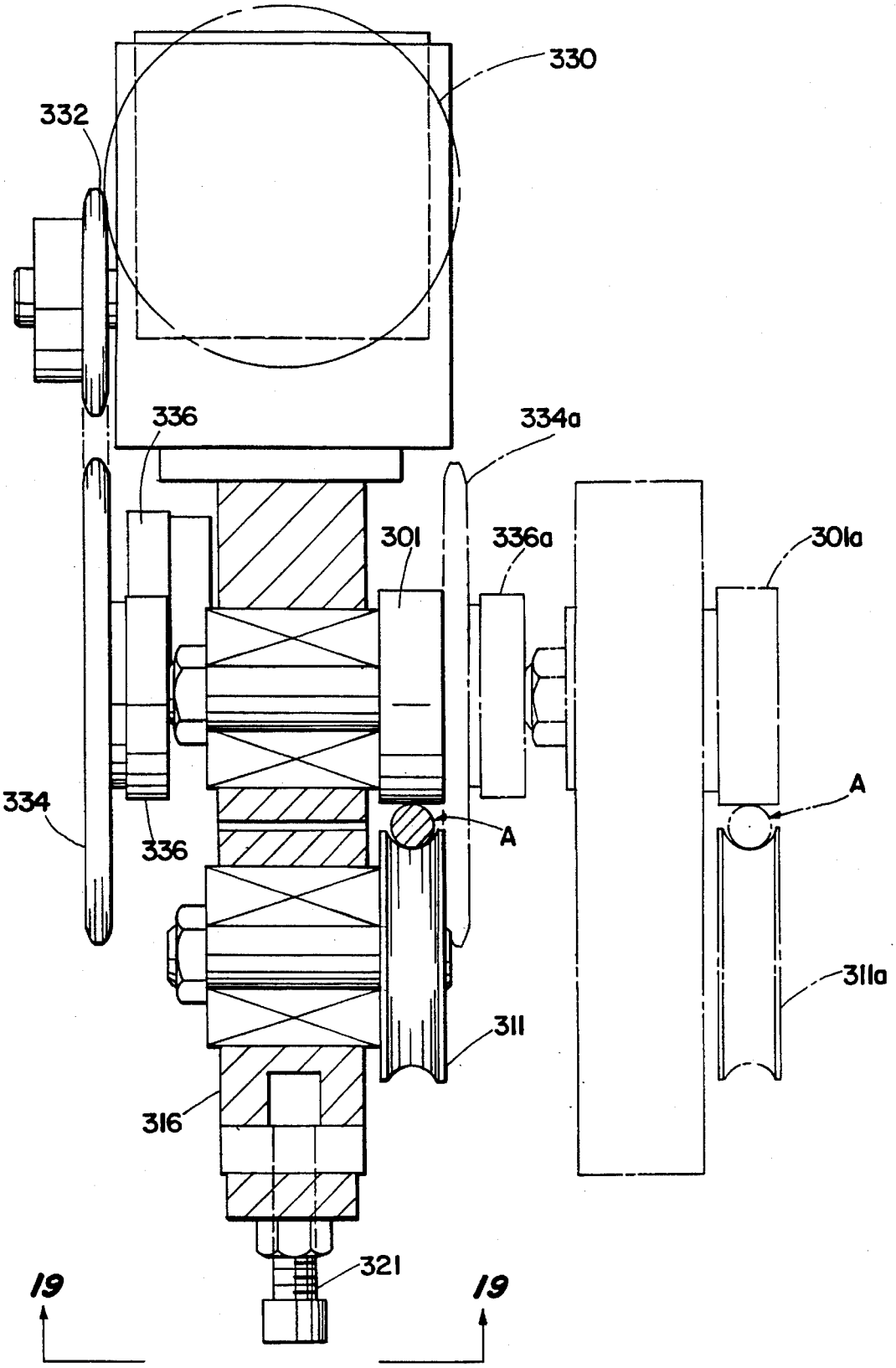
FIG. 18 is a cross-sectional elevational view taken generally on line 18—18 of FIG. 17.
Figure 19:
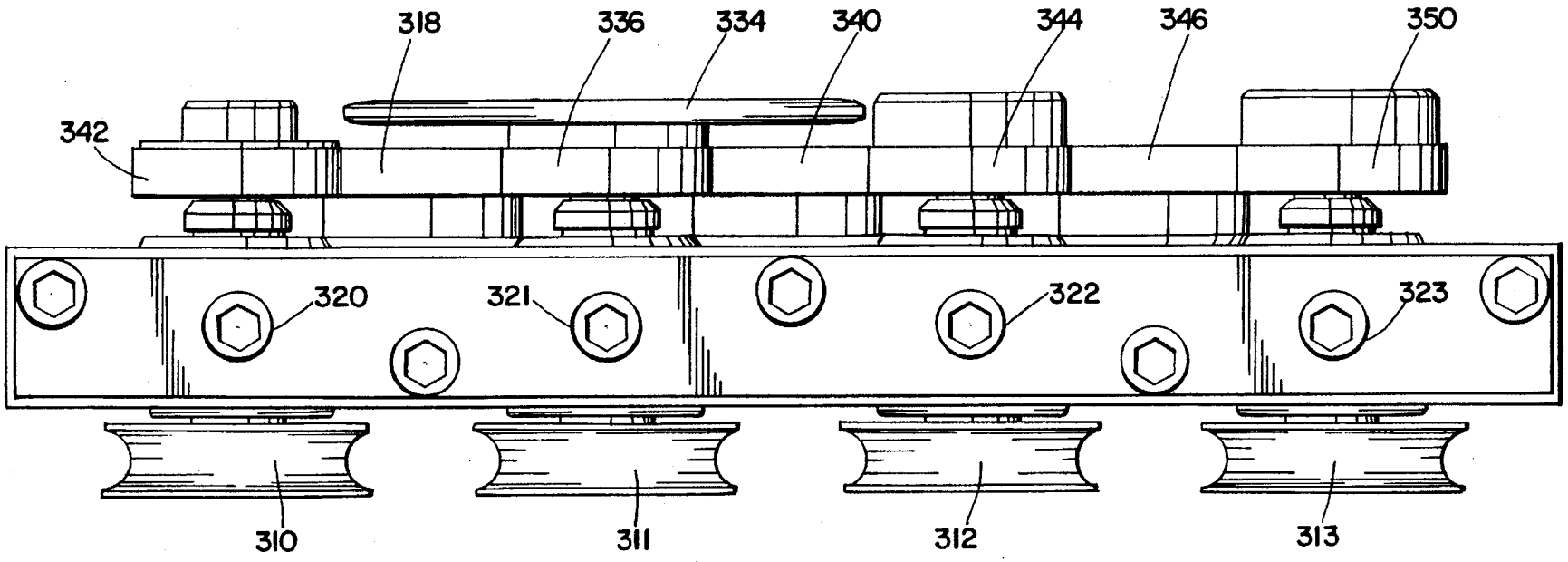
FIG. 19 is a bottom plan view taken generally on line 19—19 of FIG. 18.

FIGS. 17–19 show a longitudinal drive means E for longitudinally driving rods A through a plating system. Four rotatably driven cylindrical drive rolls 300–303 cooperate with opposed grooved idler rollers 310–313. A rod A is squeezed between opposed driving and idler rolls as indicated for rolls 301, 311 in FIG. 18. Idler rolls 310–313 are adjustably mounted on slide blocks 315–318 for movement toward and away from the drive rolls. This makes it possible to adjust the longitudinal drive means for use with different diameter rods and to accommodate wear of the rolls. Adjustment screws 320–323 are provided for adjusting each idler roll slide block. The idler rolls may also be yieldably biased toward the drive rolls.

A hydraulic drive motor 330 rotatably drives a sprocket 332 connected by a suitable chain or belt with a sprocket 334 having a gear 336 drivingly engaged with idler gears 338, 340. Idler gear 338 is engaged with a gear 342 attached to the shaft of drive roller 300, while idler gear 340 cooperates with gear 344 attached to the shaft of drive roll 302. Another idler gear 346 drivingly engages gears 344, 350 on drive rolls 302, 303.

Although rods may be fed manually between the drive and idler rolls, it is preferred to have an automatic loading mechanism for successively feeding rods one-by-one between the rolls of a longitudinal drive means. A separate longitudinal drive means is provided for each rod string, and a portion of an adjacent longitudinal drive means is indicated in shadow lines in FIG. 18 with numerals modified by the suffix "a".

It will be recognized that the longitudinal drive means can include a fluid or mechanical limited torque coupling for limiting the amount of torque capable of being supplied. For example, a friction clutch having adjustable spring force for limiting the amount of torque capable of being transmitted therethrough may be provided. In the event of a malfunction wherein the rods become jammed, the drive mechanism would simply slip. It is also possible to provide a tachometer or electronic sensor engaging the rods in a rod string at one or more positions along the length of the rod string. A malfunction causing a rod string to stop longitudinal movement would cause the tachometer or electronic sensor to trip switches, turning off the drive mechanism and the source of electric potential.

Figure 20:
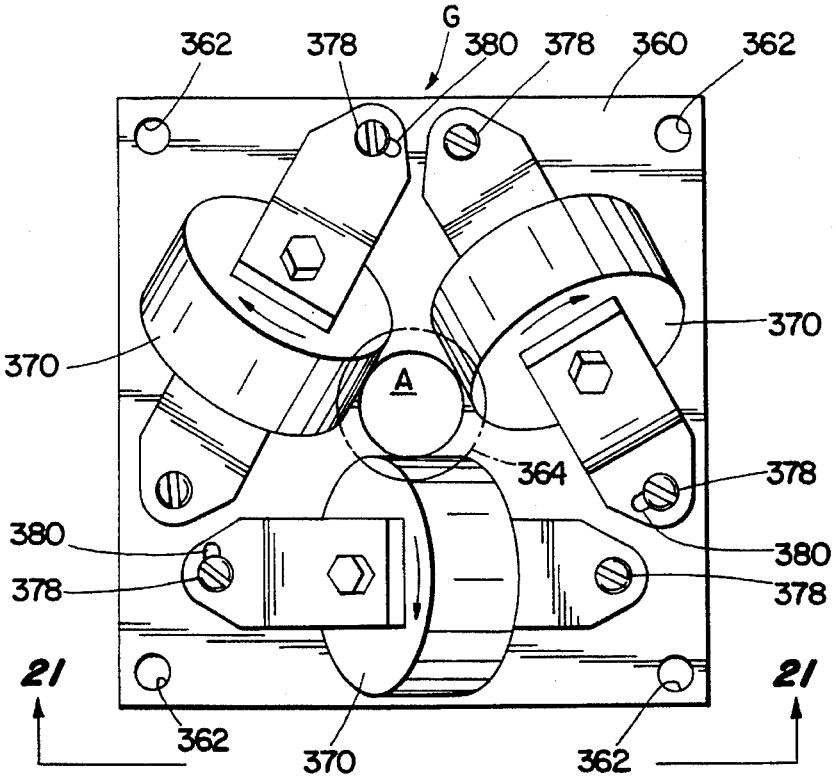
FIG. 20 is an end elevational view of a rotary drive means for rotatably driving rods.

FIG. 20 shows a rotary drive means including a rectangular mounting plate 360 having fastener receiving holes 362 therethrough alignable with the fastener receiving holes 246 in the channel of FIG. 14. Back to FIG. 20, a central hole 364 is provided in plate 360 for passage of a rod A therethrough. Three skewed cylindrical rubber rollers are mounted on plate 360 for engaging a rod A passing through hole 364.

Figure 21:
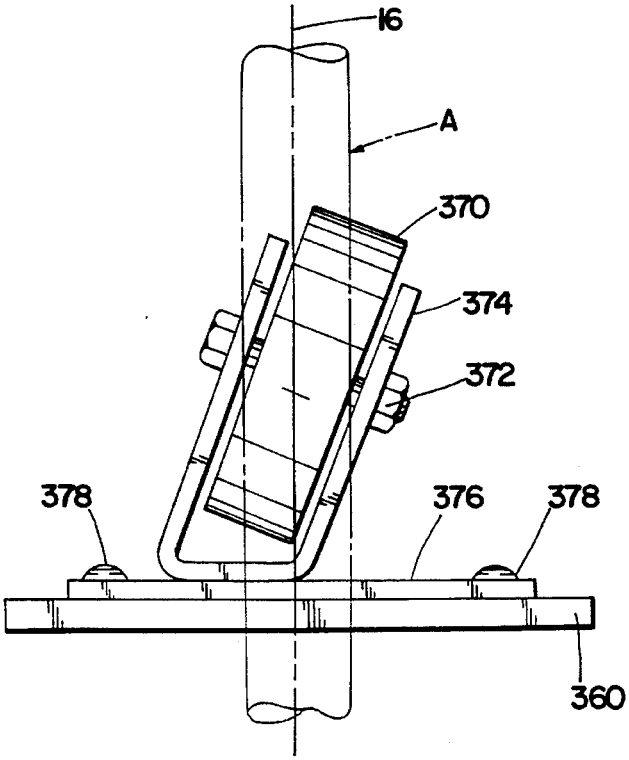
FIG. 21 is an elevational view taken generally on line 21—21 of FIG. 20.

With reference to FIG. 21, each roller 370 is rotatably mounted on a bearing shaft and fastener assembly 372 between a generally U-shaped bracket 374. As shown in FIG. 21, the legs of bracket 374 are bent or inclined relative to the longitudinal axis 16 of a rod A. Bracket 374 is welded to a plate 376 attached to mounting plate 360 by suitable fasteners 378. One of the holes in each plate 376 for a fastener 378 has an elongated slot as indicated at 380 in FIG. 23. This allows adjustable swinging movement of each plate 360 to adjust the periphery of each roll 370 relative to the longitudinal axis of hole 364. As a rod A moves longitudinally past rollers 370 in engagement therewith, the skewed relationship of the rollers relative to the rod imparts rotary force to the rod in a circumferential direction, so that the rod continues to move both longitudinally and rotatably.

Rollers C are shown skewed relative to the longitudinal axis of a rod at an included angle of about 20°. Obviously, smaller or larger skew angles are possible depending upon the desired number or fraction of numbers of rod revolutions per foot of linear rod movement. The rotary drive means may be arranged so that the rod will rotate at least one revolution for each foot of linear movement. It is preferred that a rod rotate a plurality of revolutions during its passage through a plating tank.

The linear speed of the rods depends upon the rod diameter and the type of coating being plated. For example, the linear speed may be greater when plating zinc compared to plating copper.

Figure 22:
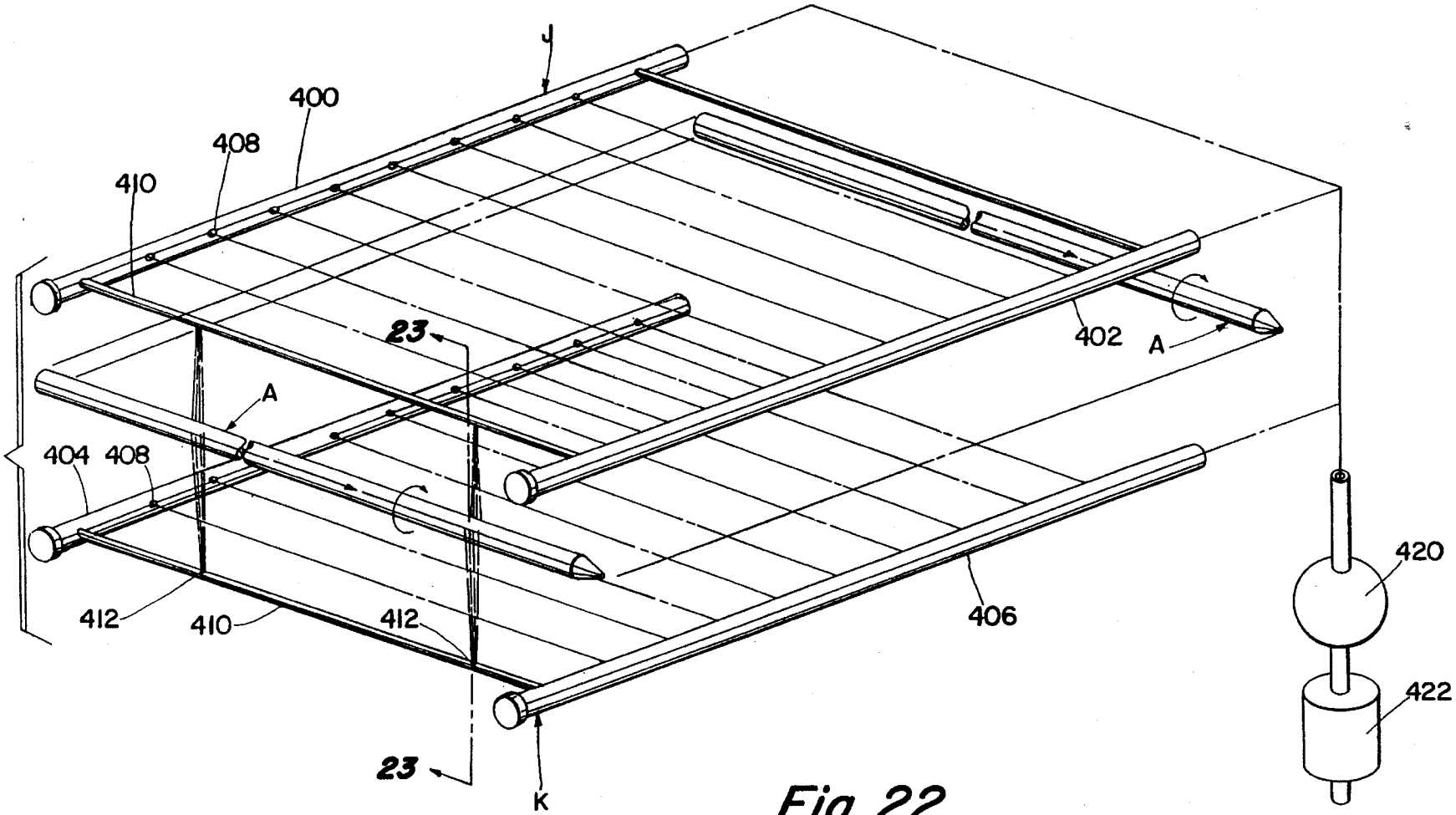
FIG. 22 is a schematic perspective illustration showing electrical ground rods moving through a plating bath between jet means for directing jets of plating solution in a swirling manner around the rods.

FIG. 22 shows upper and lower jet spray assemblies J, K, each having a pair of opposite parallel manifolds 400, 402 and 404, 406. Each manifold has ten spaced-apart holes 408 therein for receiving open ends of spray pipes 410. Each spray pipe has a plurality of spaced-apart holes 412 therein defining jet spray nozzles for spraying plating solution therethrough. Assemblies J, K are positioned in the tank of FIGS. 7–9, with pipes 410 located above and below each rod string between adjacent anode baskets. Each of the two plating chambers has the spray assemblies.

Simply by way of example, and not by way of limitation, manifolds 400–406 may be two-inch diameter plastic pipe, while spray pipes 410 are one-inch diameter plastic pipe. Each spray pipe 410 has one-sixteenth inch diameter holes 412 along the entire length thereof on one-fourth inch centers. A pump 420 and filter 22 provide solution from a mother tank to the manifolds 400–406. The higher the pressure and liquid velocity at each outlet 412 the better. The pressure at each outlet 412 is preferably not less than about 10 psig. By way of example, a pressure of about 15 psig at each outlet 412 has been used with good results combined with a jet velocity from each outlet 412 of about 3 feet per second. Higher pressure and jet velocity enable higher linear rod speed and amperage. Each orifice 412 is preferably less than about 3 inches from a rod. That is, the maximum distance from an orifice to the nearest point on the rod is not greater than about 3 inches. Most preferably, this distance is less than about 2-½ inches. The orifices 412 are closely spaced and expansion of the jets as they leave an orifice results in swirling motion of solution continuously along the length of the rod. This is further aided by the continuous longitudinal movement of the rods.

Figure 23:
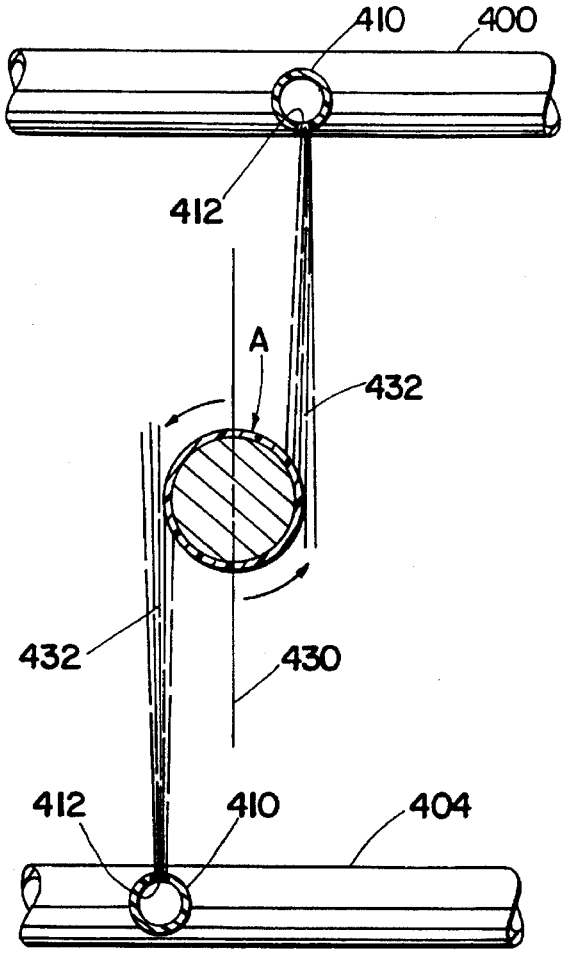
FIG. 23 is a partial cross-sectional elevational view taken generally on line 23—23 of FIG. 22.

As shown in FIG. 23, each orifice 412 is offset approximately one-quarter inch from a vertical line 430 passing through the longitudinal center of a one-half inch diameter rod A. This spacing may vary and the jets may also be inclined. The jet of solution 432 acts generally circumferentially on the rod to cause a high velocity swirling motion of plating solution therearound to replace ions depleted from the solution adjacent the surface of the rod. When the rod is simultaneously rotated with longitudinal movement, the jets 432 are preferably directed against the rod in a direction opposite to its rotational direction. This increases the relative velocity of the swirling solution with respect to the rod. The upper and lower jets are preferably longitudinally aligned so they cooperate and act on the same circumferential area of the rod. That is, each pair of upper and lower jets are in a common plane extending perpendicular to the longitudinal axis of the rod. However, the upper and lower jets could be longitudinally staggered. Obviously, the jets could be located on opposite sides of the rod instead of above and below. Also, there could be jets above, below and on opposite sides of the rod. Three jets could be arranged around the rod. Also, only one jet may be possible.

Figure 24:
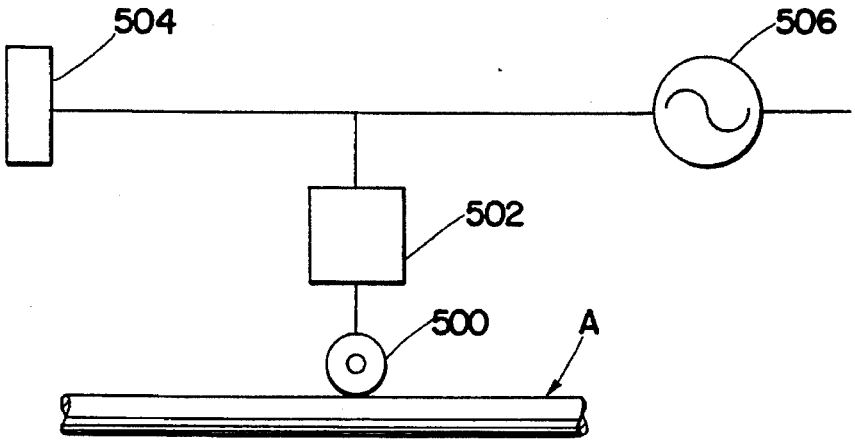
FIG. 24 is a schematic illustration showing a tachometer or electronic sensor for sensing rod motion and disconnecting a drive means and/or an electrical power source upon rod stoppage.

FIG. 24 simply shows a tachometer or electronic sensor 500 engaging a rod A and provided with a velocity sensor 502 for sending a signal to operate a switch 504 for deenergizing a power source, a drive means or an electromagnetic clutch. A power source 506 is connected with the tachometer or sensor and the switching device. Although automatic means is preferably provided for tripping switches to interrupt the drive or power in the event of a malfunction or shutdown, it is obvious that it can also be done manually upon visual observation of a malfunction.

In the event of a malfunction or shutdown, it is possible to purge the entire system using plastic rods for making repairs. Thus, the metal rods do not have to be left in place in the solutions for an extended period of time.

In an arrangement that uses only the jets, and not the rotary drive means, it is possible to obtain a substantially uniform coating that does not vary in thickness by more than about plus or minus 1 mil and most preferably about plus or minus 0.5 mil. For example, a rod may have an average electroplated coating thickness of about 10.5 mils, with a maximum of 11 mils and a minimum of 10 mils. When the rods are rotated by the rotary drive means, further improvement in uniformity is possible, with a deviation in thickness of not more than about 0.5 mil, plus or minus, and still more preferably not more than about 0.25 mils.

Although the invention has been shown and described with respect to certain preferred arrangements, it is obvious that equivalent alterations and modifications will occur to others skilled in the art upon the reading and understanding of this specification. The present invention includes all such equivalent alterations and modifications, and is limited only by the scope of the claims.

We claim:

1. An elongated substantially cylindrical electrical ground rod of a base metal, said rod having a blunt end portion with a substantially centrally located shallow dimple therein and an opposite pointed end portion that has a tapered outer surface and terminates in a substantially centrally located tip having a tip end surface area, said rod having a longitudinal axis and said tapered outer surface having a length along said axis, said dimple having a depth along said axis that is substantially less than the length of said tapered outer surface along said axis, said rod having an outer diameter at said blunt end portion that is not greater than the diameter of said rod along the remaining length of the cylindrical portion thereof, a continuous electroplated coating of a plating metal different from said base metal covering the entire outer surface of said rod except for said tip end surface area and a central surface area on said dimple that is about the same area as said tip end surface area, said rod having a cross-sectional area, and said tip end surface area and said central surface area on said dimple each having an area that is substantially smaller than the cross-sectional area of said rod.

2. The rod of claim 1 wherein said central surface area on said dimple is between 60–80% of the cross-sectional area of said rod.

3. The rod of claim 2 wherein said rod has an outer periphery, and a chamfer extending between said outer periphery and said blunt end portion, said chamfer intersecting said blunt end portion outwardly of said dimple to provide a circular flat area on said blunt end portion between said dimple and said chamfer.

4. The rod of claim 1 wherein said rod has an outer periphery, and a chamfer extending between said outer periphery and said blunt end portion, said chamfer intersecting said blunt end portion outwardly of said dimple to provide a circular flat area on said blunt end portion between said dimple and said chamfer.

5. The rod of claim 1 wherein said dimple is generally conical and has a dimple surface that slopes toward said longitudinal axis of said rod at an included angle with said axis of about 60°–80°.

6. The rod of claim 1 wherein said electroplated coating has an average thickness that is not greater than about 10.5 mils and said average thickness is substantially uniform and does not deviate by more than about 1.0 mil.

7. An electrical ground rod having a longitudinal axis, an outer diameter, an outer periphery and opposite pointed and blunt end portions, said blunt end portion including an end surface having a substantially centrally located shallow dimple therein, a chamfer extending between said outer periphery and said blunt end portion, said outer diameter of said rod at said blunt end portion being not greater than the outer diameter of said rod along the remaining length thereof, said chamfer sloping toward said longitudinal axis at a first included angle with said axis, said dimple sloping toward said longitudinal axis at a second included angle with said axis, and said second angle being substantially greater than said first angle so that the sloping of said chamfer is substantially steeper than the sloping of said dimple.

8. The rod of claim 7 wherein said rod has a cross-sectional area and said dimple has a dimple area that comprises about 60–80% of the cross-sectional area of said rod.

9. The rod of claim 7 wherein said pointed end portion has a length along said axis and said dimple is generally conical and has a depth along said axis that is substantially less than the length of said pointed end portion along said axis.

10. An elongated substantially cylindrical electrical ground rod of a base metal having opposite pointed and blunt end portions, said rod having an outer surface, a continuous electroplated coating of a plating metal different from said base metal covering substantially the entirety of said outer surface of said rod, said electroplated coating having an average thickness that is not greater than about 10.5 mils and said average thickness is substantially uniform and does not deviate by more than plus or minus 1.0 mil.

11. An elongated substantially cylindrical electrical ground rod having opposite pointed and blunt end portions, said pointed end portion having a length, and said blunt end portion having a shallow dimple therein of a depth that is substantially less than the length of said pointed end portion.

12. The rod of claim 11 wherein said rod has a longitudinal axis and said pointed end portion has a tapered outer surface that has a slope that slopes at a first included angle with said axis and said dimple has a dimple surface that has a slope that slopes at a second included angle with said axis, and said second included angle is substantially greater than said first included angle so that the slope of said dimple surface is substantially more gradual than the slope of said tapered outer surface.

13. The rod of claim 12 wherein said second angle is between about 60°–80°.

14. The rod of claim 54 wherein said rod has an outer surface and further including an electroplated metal coating on substantially the entirety of said rod outer surface, said coating having a substantially uniform thickness that does not deviate by more than about 1.0 mil over substantially the entirety of said rod outer surface.

15. The rod of claim 14 wherein said pointed end portion terminates in a tip that has a size and shape, said tip and a surface area within said dimple that substantially corresponds in size and shape with the size and shape of said tip being substantially free of said electroplated metal coating of substantially uniform thickness.

* * * * *